US010528073B2

(12) United States Patent
Williams et al.

(10) Patent No.: US 10,528,073 B2
(45) Date of Patent: Jan. 7, 2020

(54) ROTATABLE CONTROL DEVICE WITH AXIAL TRANSLATION

(71) Applicant: Snap-on Incorporated, Kenosha, WI (US)

(72) Inventors: John R. Williams, Brasstown, NC (US); Richard D. Bothmann, Grayslake, IL (US)

(73) Assignee: Snap-on Incorporated, Kenosha, WI (US)

( * ) Notice: Subject to any disclaimer, the term of this patent is extended or adjusted under 35 U.S.C. 154(b) by 805 days.

(21) Appl. No.: 14/638,627

(22) Filed: Mar. 4, 2015

(65) Prior Publication Data

US 2016/0260559 A1 Sep. 8, 2016

(51) Int. Cl.
*G05G 1/08* (2006.01)

(52) U.S. Cl.
CPC ..... *G05G 1/08* (2013.01)

(58) Field of Classification Search
CPC ..... H01H 19/585; H01H 19/58; H01H 19/63; H01H 19/6355; G05G 1/08; B25D 9/19; B25D 9/22; B25D 9/20; F16D 2125/20
USPC ..... 173/218, 168, 169
See application file for complete search history.

(56) References Cited

U.S. PATENT DOCUMENTS 3,354,732 A * 11/1967 Wickham ..... B25B 21/00 173/169
3,924,692 A * 12/1975 Saari ..... B25C 1/06 173/117
3,924,961 A * 12/1975 Hess ..... B25B 21/02 173/169
4,016,941 A * 4/1977 Sanders ..... B23D 29/00 173/170
4,315,143 A * 2/1982 Willinger ..... H05B 3/80 119/73
4,823,885 A * 4/1989 Okumura ..... B23B 45/008 173/178
4,914,928 A * 4/1990 Fellwock ..... F25D 17/045 62/408
6,062,323 A * 5/2000 Pusateri ..... B25B 21/02 173/169

(Continued)

FOREIGN PATENT DOCUMENTS

CN 2593980 Y 12/2003
CN 100532022 C 8/2009

(Continued)

OTHER PUBLICATIONS

Chinese Office Action for Application No. 201610120144.X dated Jul. 3, 2017, 8 pages.

(Continued)

*Primary Examiner* — Gloria R Weeks
*Assistant Examiner* — Dariush Seif
(74) *Attorney, Agent, or Firm* — Seyfarth Shaw LLP

(57) ABSTRACT

A mechanism for causing axial movement of a device, such as a pin, by rotating a knob in a rotational direction. The knob includes cam surfaces that, when rotated, axially adjust the device by bending an elastic frame so a portion of the frame moves toward the desired axial direction. The frame can be disposed in a substantially flush or otherwise compact manner to improve the aesthetic appearance of the mechanism and allow for a more compact and cost-effective knob.

11 Claims, 8 Drawing Sheets

(56) References Cited

U.S. PATENT DOCUMENTS

| | | | | |
|---|---|---|---|---|
| 6,082,468 | A * | 7/2000 | Pusateri | B25B 21/00 173/162.2 |
| 6,196,943 | B1 * | 3/2001 | Chen | B25B 21/00 475/254 |
| 6,274,835 | B1 * | 8/2001 | Mo | H01H 19/63 200/564 |
| 6,693,248 | B1 * | 2/2004 | Schultz | H01H 51/08 200/1 R |
| 6,796,386 | B2 * | 9/2004 | Izumisawa | B25B 21/02 173/93.5 |
| 6,883,619 | B1 * | 4/2005 | Huang | B25B 21/02 173/168 |
| 6,932,166 | B1 * | 8/2005 | Kirsch | B22D 31/00 173/206 |
| 7,223,926 | B1 * | 5/2007 | Gannon | G05G 1/082 200/11 R |
| 7,644,783 | B2 * | 1/2010 | Roberts | B25B 21/00 173/178 |
| 7,708,084 | B2 * | 5/2010 | Duesselberg | B25D 16/006 173/213 |
| 7,717,192 | B2 * | 5/2010 | Schroeder | B25D 16/006 173/104 |
| 7,802,633 | B2 * | 9/2010 | Kobayashi | B25B 21/00 137/625.43 |
| 7,896,101 | B2 * | 3/2011 | Wakabayashi | B25B 21/00 137/505.15 |
| 7,982,153 | B2 * | 7/2011 | Lin | H01H 19/11 200/568 |
| 8,647,084 | B2 * | 2/2014 | Chang | F01C 1/3446 173/168 |
| 10,072,615 | B2 * | 9/2018 | Pattullo | F02M 9/08 |
| 2004/0016630 | A1 * | 1/2004 | Muller | H01H 19/63 200/564 |
| 2007/0095409 | A1 * | 5/2007 | Chen | B25B 21/00 137/625.21 |
| 2007/0199806 | A1 * | 8/2007 | Da Dalt | H01H 19/6355 200/11 R |
| 2008/0115635 | A1 * | 5/2008 | Hellstrom | B25B 21/00 81/470 |
| 2008/0116047 | A1 * | 5/2008 | Kim | G04C 3/001 200/336 |
| 2011/0035902 | A1 * | 2/2011 | Ikeda | H01H 19/6355 16/110.1 |
| 2015/0158168 | A1 * | 6/2015 | Lauterwald | B25D 16/006 173/48 |
| 2016/0023344 | A1 * | 1/2016 | Bernhart | G05G 1/10 173/48 |

FOREIGN PATENT DOCUMENTS

| | | | |
|---|---|---|---|
| GB | 2421285 | A | 6/2006 |
| TW | 222241 | B | 4/1994 |
| TW | 367926 | U | 8/1999 |
| TW | 410715 | U | 11/2000 |
| TW | 201210754 | A | 3/2012 |
| TW | 201330994 | A | 8/2013 |
| TW | 201330994 | A1 | 8/2013 |

OTHER PUBLICATIONS

UK Examination Report for Application No. 1521737.5 dated Jul. 27, 2017, 4 pages.

United Kingdom Intellectual Property Office Combined Search and Examination Report, dated Apr. 2, 2016; 9 pages.

Australian Government Patent Examination Report No. 1, dated Jan. 22, 2016; 5 pages.

Taiwan-Office Action, dated Sep. 14, 2016; 11 pages.

* cited by examiner

ROTATABLE CONTROL DEVICE WITH AXIAL TRANSLATION

RELATED APPLICATIONS

The present invention relates to the invention(s) disclosed in U.S. patent application Ser. No. 14/633,400, the disclosure of which is incorporated herein in its entirety.

TECHNICAL FIELD OF THE INVENTION

The present invention relates generally to control devices. More particularly, the present invention relates broadly to a rotatable control device that converts rotational movement of a knob to axial translation.

BACKGROUND OF THE INVENTION

Tools and other devices often include knobs or other interfaces that control various components. For example, knobs can be used with pneumatic air tools to control the amount of air flow by controlling an internal valve to allow air to flow into a passage. Many power tools include knobs that are neither easy to control nor aesthetically pleasing. Instead, these knobs are often located at a lower corner of the tool. Typically, the knob is operably coupled to many internal air passages to control the air flow, increasing the risk of air leakage or otherwise result in pressure losses. Other conventional knobs locate the flow control components in a manner that increase the size of the tool or adversely affect the ergonomics or use of the tool, complicating the manufacturing process and increasing the cost of manufacturing the tool.

SUMMARY OF THE INVENTION

An embodiment of the present invention includes a mechanism for translating rotational movement of a rotatable knob to axial movement of an operably coupled device. The mechanism includes a rotatable knob having cam surfaces on a first side that, when rotated, axially move a pin or other device. The knob can interface with the pin through a bendable or elastic frame coupled to a housing in a substantially flush or otherwise compact manner to improve the aesthetic appearance and compact nature of the mechanism.

Another embodiment of the present invention comprises a control device including a knob rotatably coupled to a backside of a housing of a tool, for example, having a first surface facing the tool with a first cam surface extending partially along an outer periphery of the knob, where the first cam surface has a first raised portion at a first end that tapers to a first lower portion at a second end, a bendable or elastic frame coupled to the housing and having one or more contact surfaces adapted to cooperatively engage the first cam surface, and an axially translatable device disposed in the tool and which abuts or is coupled to a backside of one of the contact surfaces, wherein when the knob is rotated, it causes the first cam surface to rotate, wherein at least one of the contact surfaces follows the contour of the first cam surface and moves inwardly or outwardly relative to the tool, which causes the device to move axially inwardly or outwardly relative to the tool.

Moreover, one or more of the contact surfaces may include a detent structure, such as a convexity or other outward protrusion, that is adapted to cooperatively engage spaced detents disposed on the first cam surface, such as depressions, which are spaced apart relative to each other at intervals that represent specific amounts of axial displacement of the device, wherein rotation of the knob causes the detents to cooperatively engage to provide tactile and/or audible feedback to a user that a specific axial displacement of the device has been obtained, and the detents detain the knob from further rotation, thereby detaining the axial position of the device relative to the tool, unless additional rotational force is applied to the knob by the user.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION OF THE EMBODIMENTS

Figure 1:
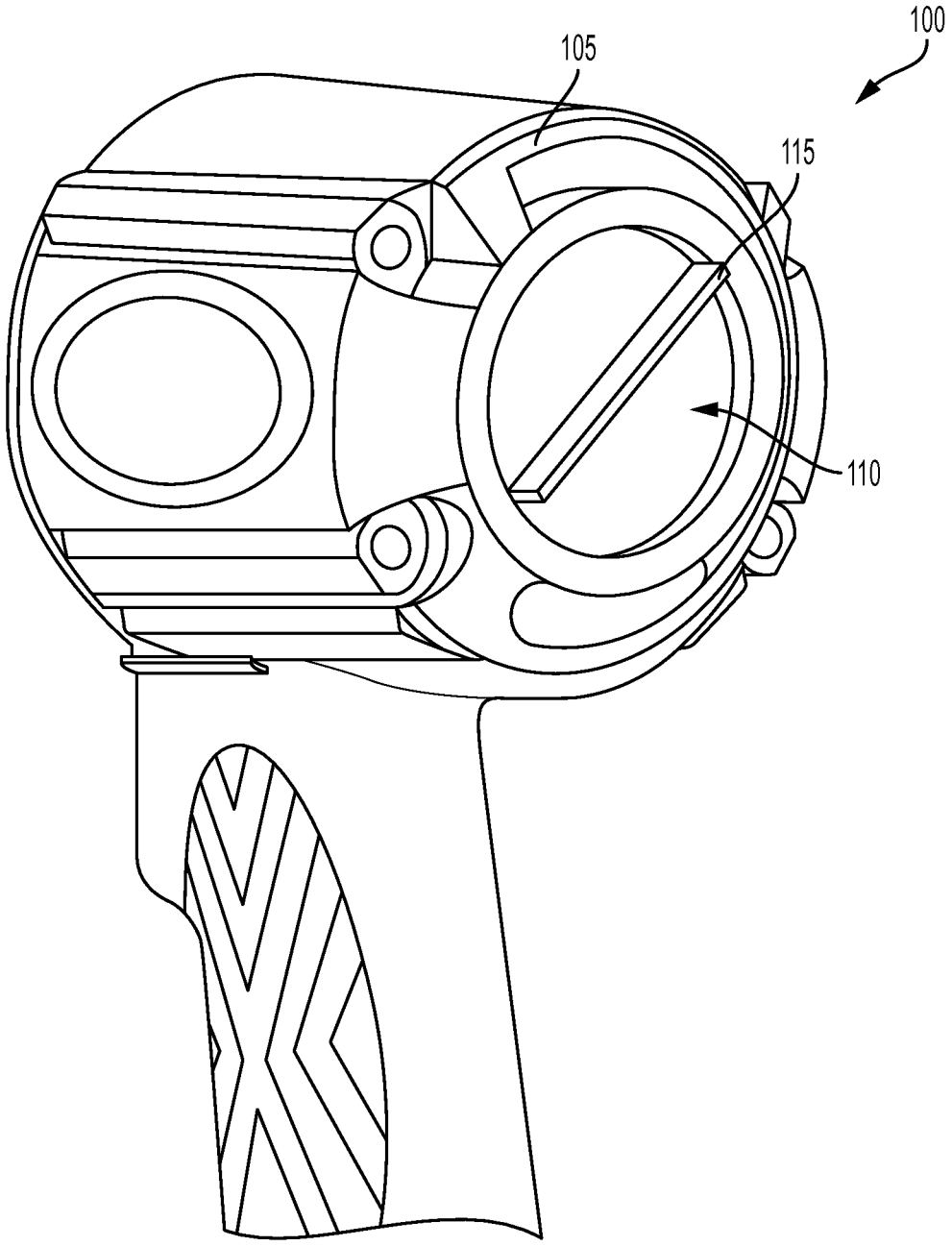
FIG. 1 is a partial rear perspective view of an embodiment of the present invention utilized on a tool.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated.

An embodiment of the present invention broadly comprises a mechanism that translates rotational movement into axial movement by rotating a knob in a rotational direction. The knob includes a first surface with one or more cam surfaces disposed along a peripheral edge of the knob. A bendable or elastic frame is disposed between the cam surfaces and an axially movable device to facilitate the axial movement of the device upon rotation of the knob. The knob can be rotatably coupled to a housing of a tool, such as a pneumatically powered tool, in a substantially flush or otherwise compact manner to improve the aesthetic appearance of the mechanism and allow for a more compact and cost-effective knob. It will be appreciated that while the present invention is discussed in terms of applicability and use with a tool, the present invention is adaptable and useable with any type of mechanism or device where rotational-to-axial translational movement is desired. Therefore, the present invention is not limited to use with a tool.

Referring to FIG. 1, a device, shown as tool 100, for example, includes a housing 105 and a knob 110 rotatably coupled to the housing 105. The knob 110 includes first 110*a* and second 110*b* knob surfaces, wherein the first knob surface 110*a* faces inwardly and the second knob surface 110*b* faces outwardly, relative to the housing 105. The knob 110 can include an outwardly extending handle or grip 115 disposed radially across the knob second surface 110*b* to assist a user in gripping the knob 110 for rotational movement. In an embodiment, the outer circumferential surface of the knob 110 can be textured, such a knurled, for better grip during rotational movement. In an embodiment, and when used with a powered tool, when rotated, the knob 110 is adapted to cause regulation of motor power. However, it will be appreciated that the knob 110 is not so limited, and can be implemented in any form to cause axial movement of any device when rotated. Moreover, in an embodiment, the outer circumferential edge of the knob 110 may include an annular groove having a sealing ring 117, such as an elastic or rubberized O-ring, disposed therein, so that when the knob 110 is rotatably coupled to the housing 105 in a recess configured to rotatably receive the knob 110, the sealing ring 117 cooperatively engages the wall of the recess to provide a substantially fluid-tight and/or air-tight relationship.

Figure 2:
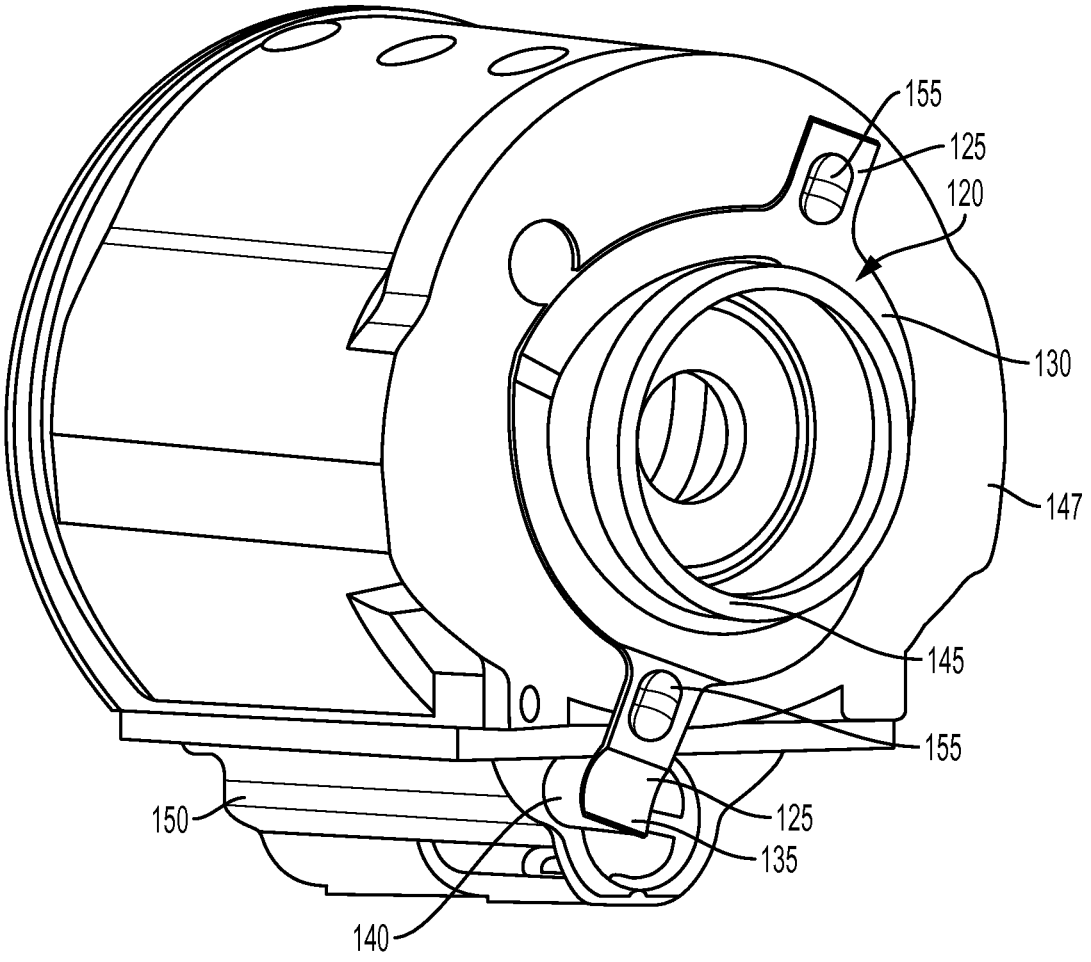
FIG. 2 is a rear perspective view of a cylinder, frame, and plate assembly according to embodiments of the present invention.

Referring to FIG. 2, a bendable or elastic, substantially annular frame 120, such as a rocker spring, includes diametrically opposing tabs 125, each having a contact surface, that extend radially outwardly from frame 120. In an embodiment, only one tab 125 is provided. An extension 135 can extend from a lower tab 125 and can be operably coupled to an axially movable device, such as a pin 140. In an embodiment, the extension 135 has a surface that abuts or contacts pin 140. The pin 140 is adapted to move axially relative to the frame 120, and can be any device where axial movement is desired and achievable.

Figure 3:
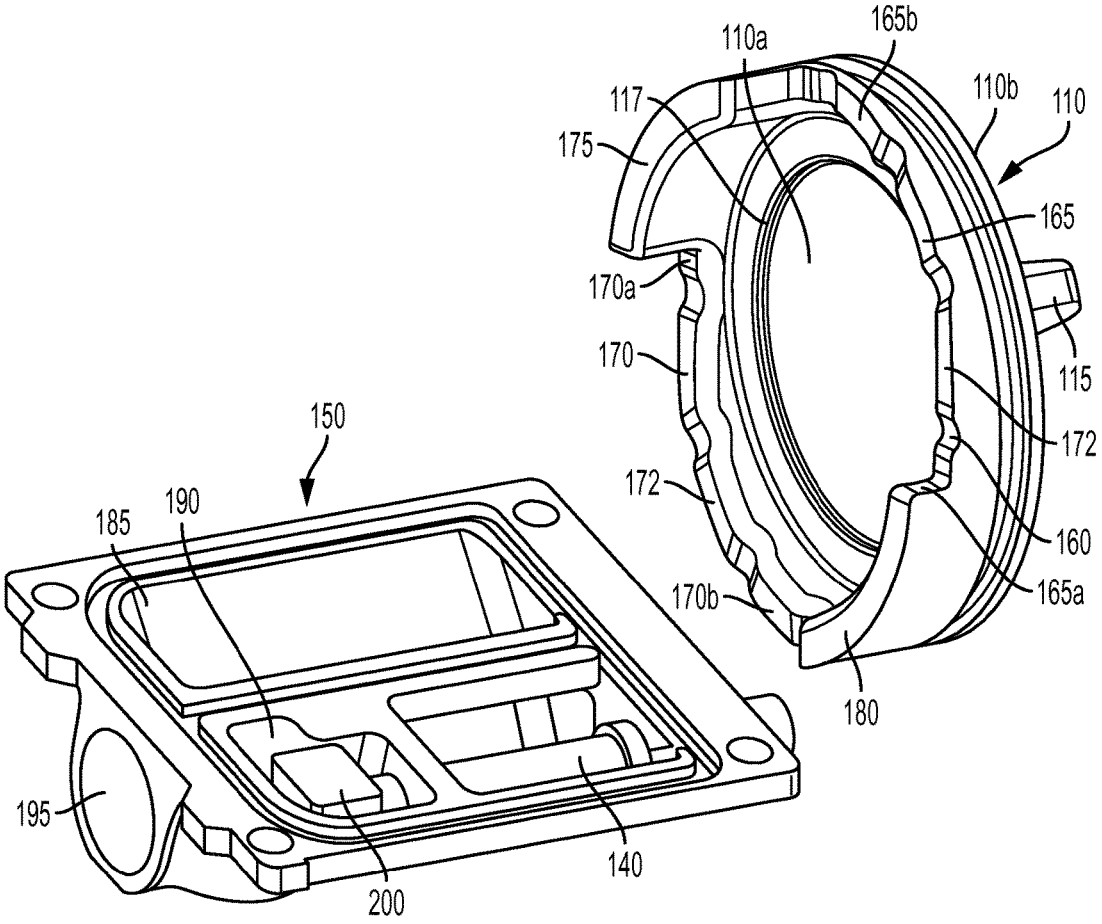
FIG. 3 is a partial exploded front perspective view of a plate and knob according to embodiments of the present invention.

Referring also to FIG. 3, the knob 110 can include a first cam surface 165 accurately disposed around the outer periphery of the first knob surface 110*a* having a first raised portion 165*a* at a first end tapering to a first lower portion 165*b* at a second end. Similarly, the knob 110 can include a second cam surface 170 diametrically opposite of the first cam surface 165 and having a second raised portion 170*a* at a first end tapering to a second lower portion 170*b* at a second end. The first cam surface 165 and second cam surface 170 can extend from a first wall 175 and a second wall 180 around an outer periphery of the knob 110.

The cam surfaces 165, 170 can be tapered in any manner. For example, the cam surfaces 165, 170 can be raised at a clockwise-most position and lower at a counterclockwise-most position, or vice versa. The cam surfaces 165, 170 can also be tapered opposite one another, but in an embodiment, the cam surfaces 165, 170 are sloped in the same rotational direction to provide a tilting effect to the frame 120 during operation, as described below. Further, the walls 175, 180 can act as stops to substantially prevent over-rotation of the knob 110 during use. For example, the walls 175, 180 can rotate with the knob 110 and abut against the tabs 125 when rotated against the frame 120, thus preventing further rotation of the knob 110.

Figure 5A:
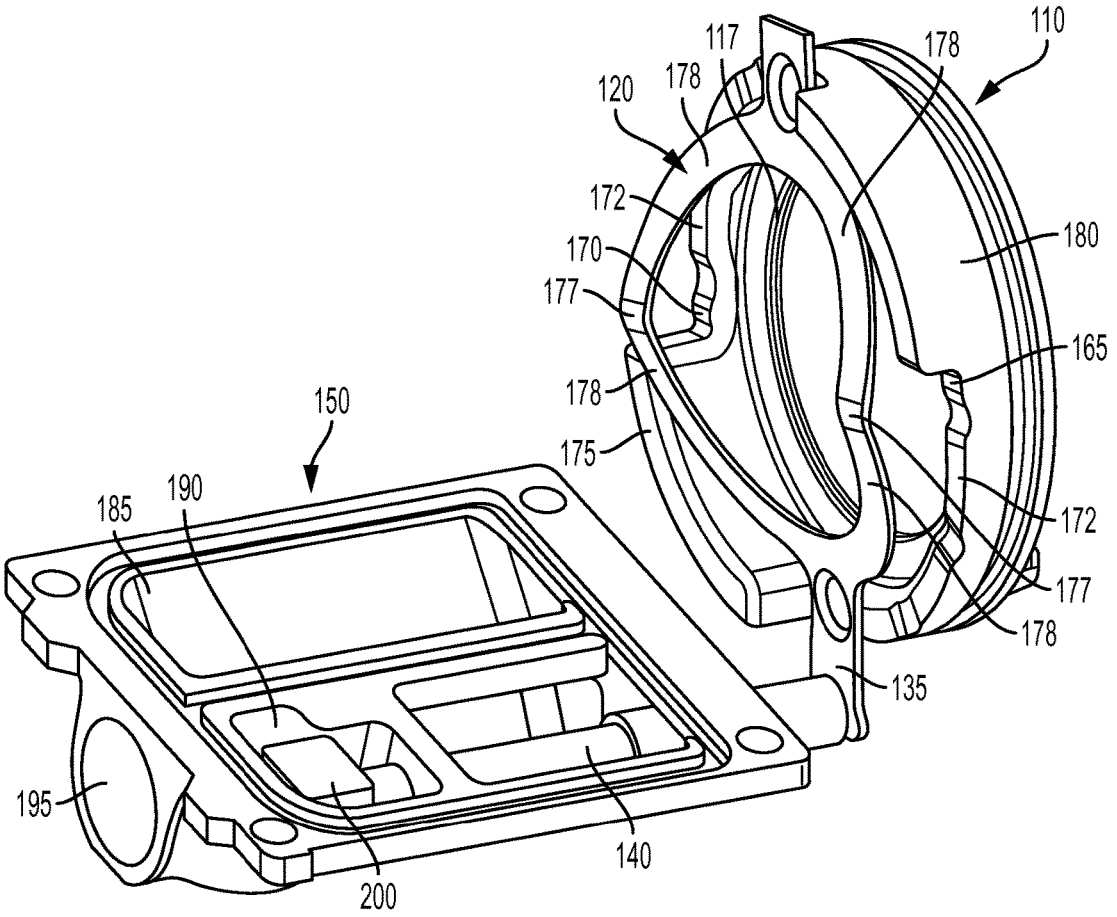
FIG. 5A is a partial assembled front perspective view of various components of embodiments of the present invention.
Figure 5B:
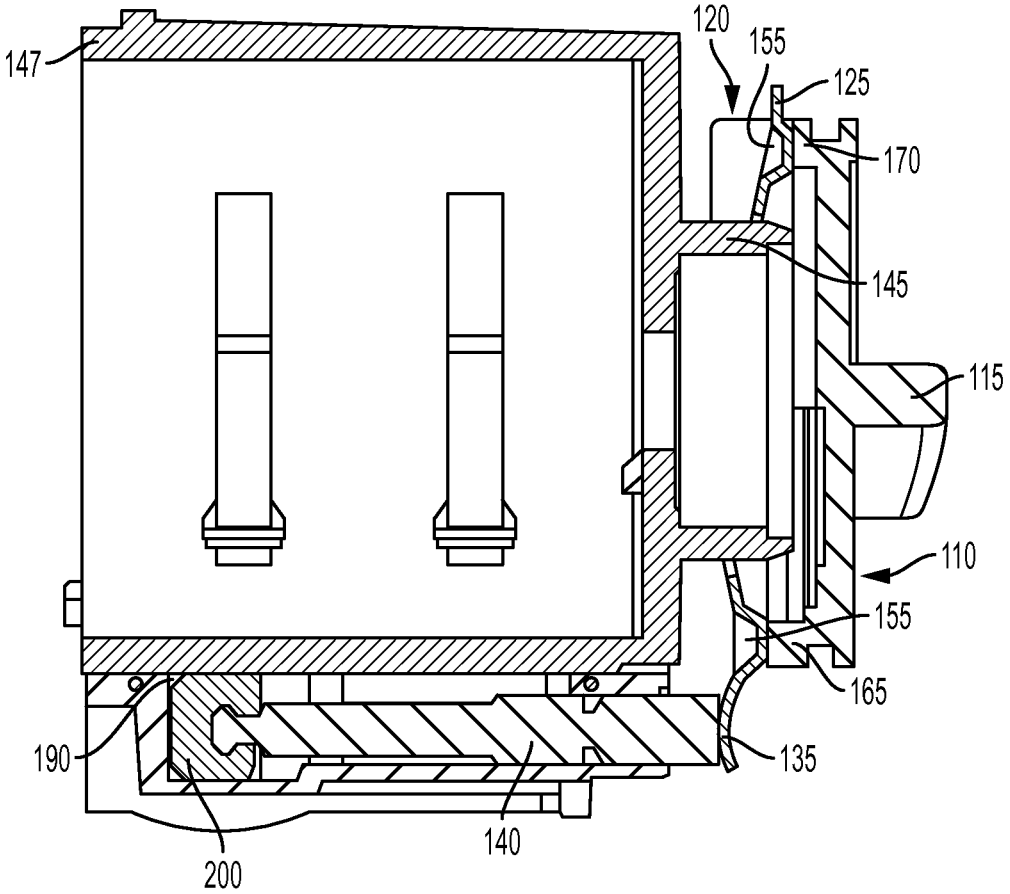
FIG. 5B is a partial side sectional view of various components of embodiments of the present invention.

As shown, rotational movement of the knob 110 causes rotational movement of the cam surfaces 165, 170. The tabs 125 respectively cooperatively engage respective cam surfaces 165, 170, and follow the profile of the cam surfaces 165, 170, during rotation of the knob 110. Therefore, the tabs 125 move axially inwardly and outwardly, relative to the housing 105, when the knob 110 is rotated and depending on the profile of the cam surfaces 165, 170 that abut the tabs 125. For example, and as shown in FIGS. 5A and 5B, clockwise rotation of the knob 110 causes the profiles of the cam surfaces 165, 170 to move from a first distance relative to the housing 105 to a second, closer distance relative to the housing 105, due to the tapered nature of the cam surfaces 165, 170. Therefore, during rotation of the knob 110, the tabs 125 abut and cooperatively engage the cam surfaces 165, 170, and the lower tab 125 can move axially inward relative to the housing 105, while the upper tab 125 moves axially outward, due to the profiles of the cam surfaces 165, 170. The cam surfaces 165, 170 accordingly change the distance of the tabs 125 relative to the housing 105 in opposite directions, and in so doing, cause the frame 120 to apply a constant force to the knob 110. Therefore, because lower tab 125 moves inwardly relative to the housing 105, the extension 135 moves inwardly as well. When extension 135 moves inwardly, it pushes the pin 140 axially inward, thus translating the rotational movement of the knob 110 to axial movement of the pin 140.

Figure 4A:
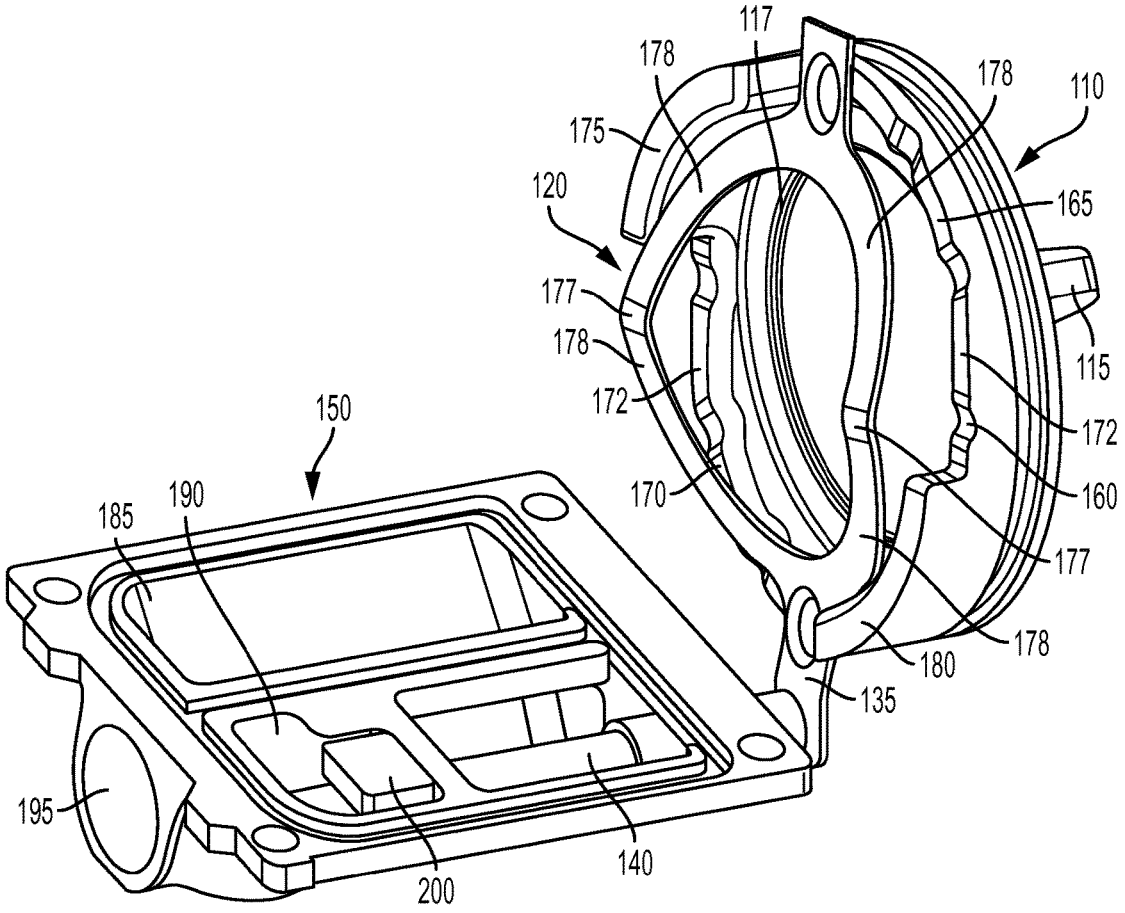
FIG. 4A is a partial assembled front perspective view of various components of embodiments of the present invention.
Figure 4B:
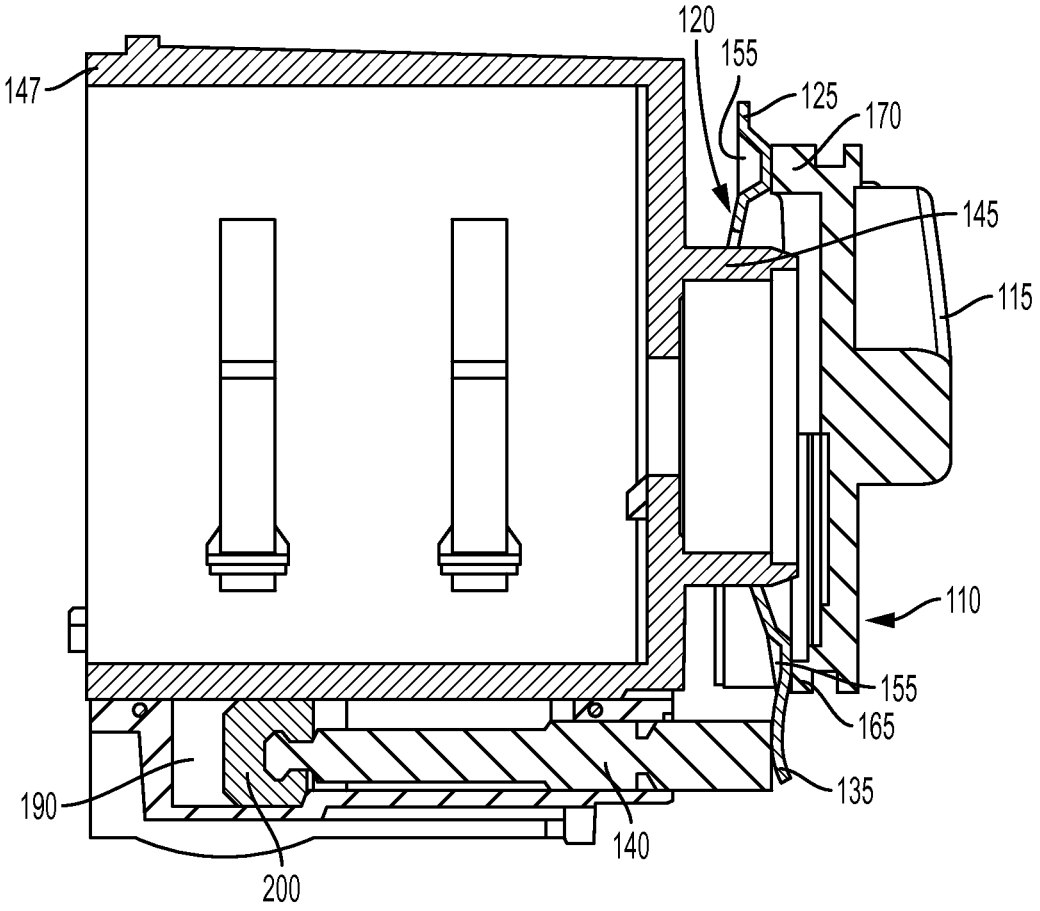
FIG. 4B is a partial side sectional view of various components of embodiments of the present invention.

Likewise, when the knob 110 is rotated in the opposite rotational direction, and due to the bendable or elastic nature of the frame 120, which biases the frame 120 outwardly relative to the housing 105, the lower tab 125 moves axially outward, relative to the housing 105, and the upper tab 125 moves axially inward, due to the tapered nature of the cam surfaces 165, 170. Therefore, during rotation of the knob 110, and because the tabs 125 abut and cooperatively engage the cam surfaces 165, 170, the lower tab 125 moves axially outward relative to the housing 105, due to the profiles of the cam surfaces 165, 170, as shown in FIGS. 4A and 4B. Because the lower tab 125 moves outwardly relative to the housing 105, the extension 135 moves outwardly as well. When the extension 135 moves outwardly, it either pulls the pin 140 axially outwardly, if the pin 140 is coupled to extension 135, or allows the pin 140 to move axially outwardly, if the pin 140 is biased outwardly by, for example, a spring or other biasing structure.

In an embodiment, one or more of the surfaces of the tabs 125 that contact cam surfaces 165, 170 may include a detent structure, such as a convexity or other outward protrusion 155. In an embodiment, the convexity or outward protrusion 155 is oblong or oval in shape. The protrusion 155 is adapted to cooperatively engage spaced detents 160 disposed on the cam surfaces 165, 170, such as depressions or steps, which can be spaced apart at specific intervals to represent specific amounts of axial displacement of the pin 140. The detents 160 can extend in a direction parallel to the first face 110*a* of the knob 110 in a stepped configuration, as shown in FIG. 3, or can extend at the same angle as surface portions 172. Rotation of the knob 110 causes the protrusion 155 to cooperatively engage the detent 160 to provide tactile and/or audible feedback to a user that a specific axial displacement of the pin 140 has been obtained. Moreover, the protrusion 155 and detent 160 interface can detain the knob 110 from further rotation unless additional rotational force is applied by the user, thus also detaining the axial position of the pin 140.

Figure 6:
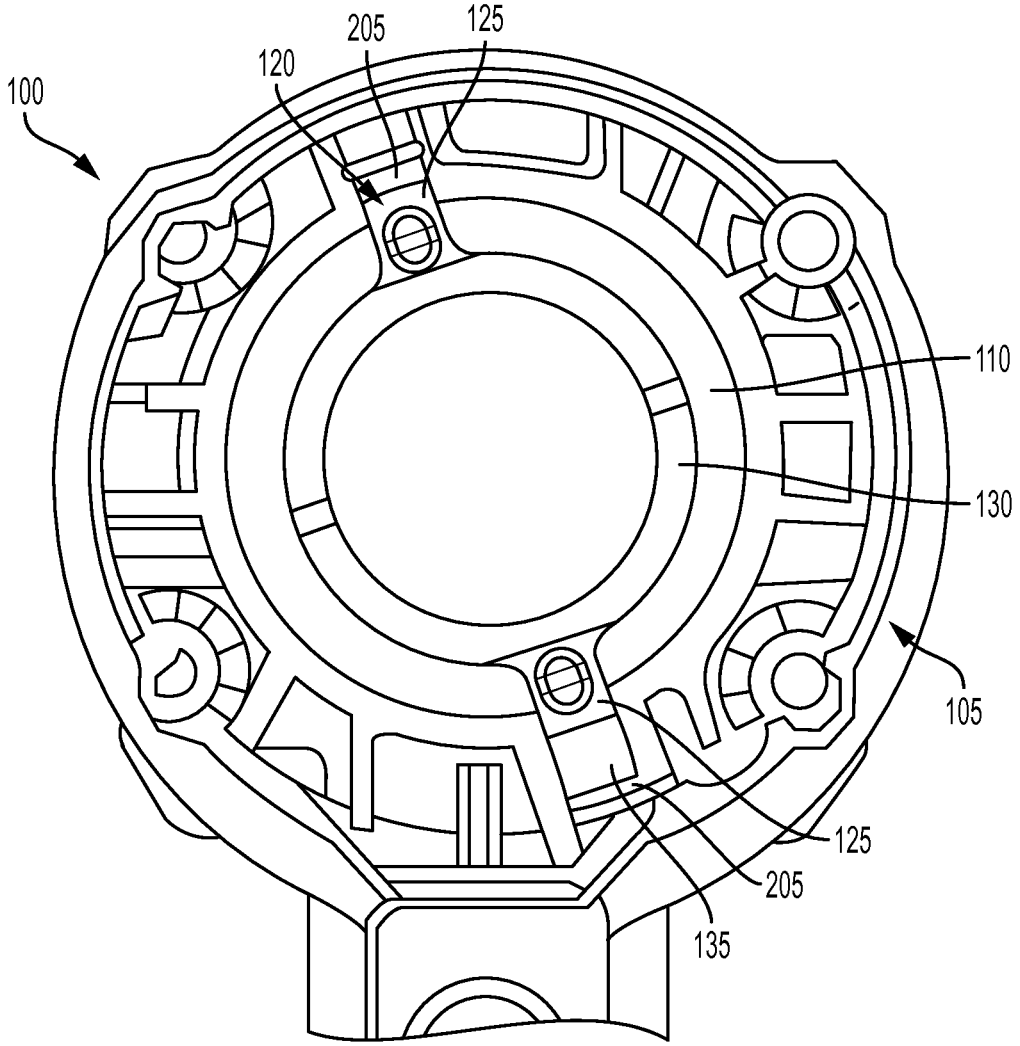
FIG. 6 is a partial front sectional view of an embodiment of the present invention.

Referring to FIG. 6, the frame 120 can be coupled to the housing 105 to prevent rotation and radial displacement of the frame 120 relative to the knob 110. For example, the frame 120 can be radially constrained by an outwardly extending cylinder 147 disposed on the housing 105. In an embodiment, the tabs 125 can also be disposed in receiving grooves 205 disposed on the housing 105 to prevent rotation of the frame 120 relative to the housing 105 and knob 110, but still allowing axial movement of the tabs 125 when the frame 120 flexes during use.

In an embodiment, the cam surfaces 165, 170 can be cooperatively configured and tapered so opposing tabs 125 can misalign relative to a plane, as shown in FIGS. 4B and 5B. For example, the frame 120 can flex under the force of the cam surfaces 165, 170, thus causing tabs 125 to planarly misalign. It has been found that such planar misalignment provides a better balance of the present invention. In particular, the flexing stresses placed on one of the tabs 125, caused by one of the cam surfaces 165, counter-balances the flexing stresses place on the opposing tab 125, caused by the opposing cam surface 175.

The frame 120 can include mid-portions 177 with radial portions 178 extending from the mid-portions 177. The mid-portions 177 and the radial portions 178 can be integrally formed, but the mid-portions 177 can be angled or bent with respect to the radial portions 178. Accordingly, the radial portions 178 can flex or bend with respect to the mid-portions 177 when contacting the housing 105, therefore providing a rocker effect to the frame 120.

As shown in FIG. 2, the frame 120 can be substantially flush with or otherwise compactly disposed against the housing 105 for a compact and space-efficient assembly. For example, the circumferential section 130 can surround a ring 145 and can be located at or near the cylinder 147. This arrangement, in combination with the tab 125 and groove 205 interface, allow for an easy to implement and compact arrangement of the frame 120 within the tool 100. For example, the frame 120 can be movably coupled to the housing 105 by coupling the tabs 125 to the grooves 205 so that rotational movement of the frame 120 about its central axis is substantially prevented, but the frame 120 can still tilt, as discussed above.

The examples discussed above contemplate use of the present invention with a powered tool, such as a pneumatically powered tool. However, the present invention is not so limited, and can be implemented in any type of tool, or any type of device where rotational-to-axial translation is desired.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A control device for translating rotational movement to axial movement, comprising:

a rotational knob rotatably coupled to a housing and having first and second knob surfaces, the first knob surface faces axially inward and has a first cam surface arcuately disposed along an outer periphery of the knob, the first cam surface has a first raised portion at a first end tapering to a first lower portion at a second end;

an annular frame axially aligned with the knob and having an extension extending radially outward from the frame and beyond the outer periphery of the knob; and an axially movable device coupled to the extension, wherein the first cam surface is adapted to operatively engage the extension, and when the knob is rotated relative to the frame, the first cam surface causes the extension to move axially relative to the knob and the housing, which causes the axially movable device to move axially relative to the knob and the housing.

2. The control device of claim 1, further comprising a first tab extending radially from the frame to couple the extension to the frame, wherein the first tab includes a first tab surface that abuts the first cam surface.

3. The control device of claim 2, wherein the first tab surface includes a first detent structure and the first cam surface includes a second detent structure, wherein the first and second detent structures cooperatively engage to provide a tactile indication to a user of the control device.

4. The control device of claim 3, wherein the first cam surface includes spaced apart second detent structures, and wherein the first detent structure and one of the second detent structures cooperatively engage to provide the tactile indication.

5. The control device of claim 4, wherein the spaced apart second detent structures are spaced steps.

6. The control device of claim 3, wherein the first detent structure has a convexity shape.

7. The control device of claim 2, wherein the first knob surface includes a second cam surface disposed along the outer periphery diametrically opposing the first cam surface, the second cam surface has a second raised portion at a first end of the second cam surface tapering to a second lower portion at a second end of the second cam surface.

8. The control device of claim 7, wherein the frame includes a second tab extending radially from the frame diametrically opposed to the first tab, wherein the second tab includes a second tab surface adapted to abut the second cam surface.

9. The control device of claim 1, wherein when the knob is rotated in a first rotational direction, the first cam surface is adapted to push the axially movable device axially in a first axial direction, and when the knob is rotated in a second rotational direction, the first cam surface is adapted to allow the axially movable device to axially move in a second axial direction opposite the first axial direction.

10. The control device of claim 1, further comprising a cylinder and a ring, wherein the frame includes a circumferential portion that surrounds the ring.

11. The control device of claim 1, wherein the housing includes a groove, and wherein the frame includes a circumferential section and a tab extending from the circumferential section, and the tab cooperatively engages the groove to retain the frame against the housing.

* * * * *